US006105470A

United States Patent [19]

Hutchins

[11] Patent Number: 6,105,470

[45] Date of Patent: Aug. 22, 2000

[54] SHINGLE REMOVING TOOL

[76] Inventor: Robert J. Hutchins, 7618 Forest Rd., Cincinnati, Ohio 45255

[21] Appl. No.: 09/193,949

[22] Filed: Nov. 18, 1998

[51] Int. Cl.[7] ..... E04D 15/00

[52] U.S. Cl. ..... 81/45; 30/170

[58] Field of Search ..... 81/45, 44; 30/170

[56] References Cited

U.S. PATENT DOCUMENTS

| | | | |
|---|---|---|---|
| 4,756,578 | 7/1988 | Mims et al. | 299/37 |
| 5,218,766 | 6/1993 | Himebaugh | 30/170 |
| 5,800,021 | 9/1998 | Derr | 299/37.1 |
| 5,860,519 | 1/1999 | Meyer et al. | 206/315.3 |
| 5,921,155 | 7/1999 | Faller et al. | 81/45 |

*Primary Examiner*—Eileen P. Morgan
*Assistant Examiner*—Hadi Shakeri
*Attorney, Agent, or Firm*—Frost & Jacobs LLP

[57] ABSTRACT

A motorized shingle removing hand tool comprising a blade assembly shiftable between a normal extended position and a retracted position. The blade assembly is biased to its normal extended position and is shifted to its retracted position by a motor driven cam which thereafter allows the blade assembly to be driven to its extended position by the biasing mechanism. The tool comprises a base on which the motor is mounted. The blade assembly comprises a blade and its support mechanism which is mounted in bushing blocks affixed to the base. The base is provided with an openable cover to keep the motor, the cam, the blade support mechanism, the biasing elements and the bushings free from dirt and foreign material. The tool includes an adjustable handle and an actuating trigger with an associated variable speed control switch, and a carrying strap.

16 Claims, 5 Drawing Sheets

SHINGLE REMOVING TOOL

TECHNICAL FIELD

The invention relates to a shingle-removing tool, and more particularly to such a tool comprising a powered hand tool with a reciprocating shingle-removing blade.

BACKGROUND ART

The tool of the present invention is intended to be used in the removal of old roofs. Roof removal is a labor-intensive operation. Frequently there are two layers of roofing material which must be removed down to the sheathing to which the shingles are nailed. The removal operation is generally accomplished manually with hand tools.

The present invention provides a motorized tool which enables the roof removal operation to be accomplished more easily and quickly. The tool rapidly and efficiently undercuts the shingles and roofing nails lifting the shingle material and pushing it ahead of the tool.

The tool is simple in construction and easy to operate. The tool is also easy to clean and service.

DISCLOSURE OF THE INVENTION

According to the invention there is provided a motorized shingle removing hand tool. The tool comprises a base which supports the drive mechanism for a blade located in front of the base. The blade has a forward cutting edge and a rearward surface to which a pair of blade driving bars are affixed. The blade driving bars extend rearwardly of the blade in parallel spaced relationship and are slidably mounted in a pair of front support bushing blocks. The rearward ends of the blade driving bars are affixed to a compression plate which extends transversely of the base. The compression plate mounts a pair of rearwardly extending driven bars, the rearward ends of which are affixed to a cam follower plate extending transversely of the base and parallel to the compression plate. The compression plate, the driven bars and the cam follower plate form a rectangular frame-like structure to which the blade is attached by the blade driving bars. The driven bars of the frame-like structure pass through perforations in a fixed plate mounted on the base. Thereafter, the driven bars pass through rear support and bushing blocks.

By virtue of this construction, the blade is reciprocable between a normal forward position and a rearward position. The blade is biased to its normal forward position by compression springs mounted on the driven bars between the fixed plate and the compression plate which serve as seats for the compression springs. The blade is shifted to its rearward position by a cam driven by a motor and operatively acting upon a cam follower roller mounted in the cam follower plate.

The base is provided with a removable cover and the tool is provided with a handle which may be adjusted with respect to the base by adjustment knobs threadedly engaged in the rear support bushing blocks.

DETAILED DESCRIPTION OF THE INVENTION

Figure 1:
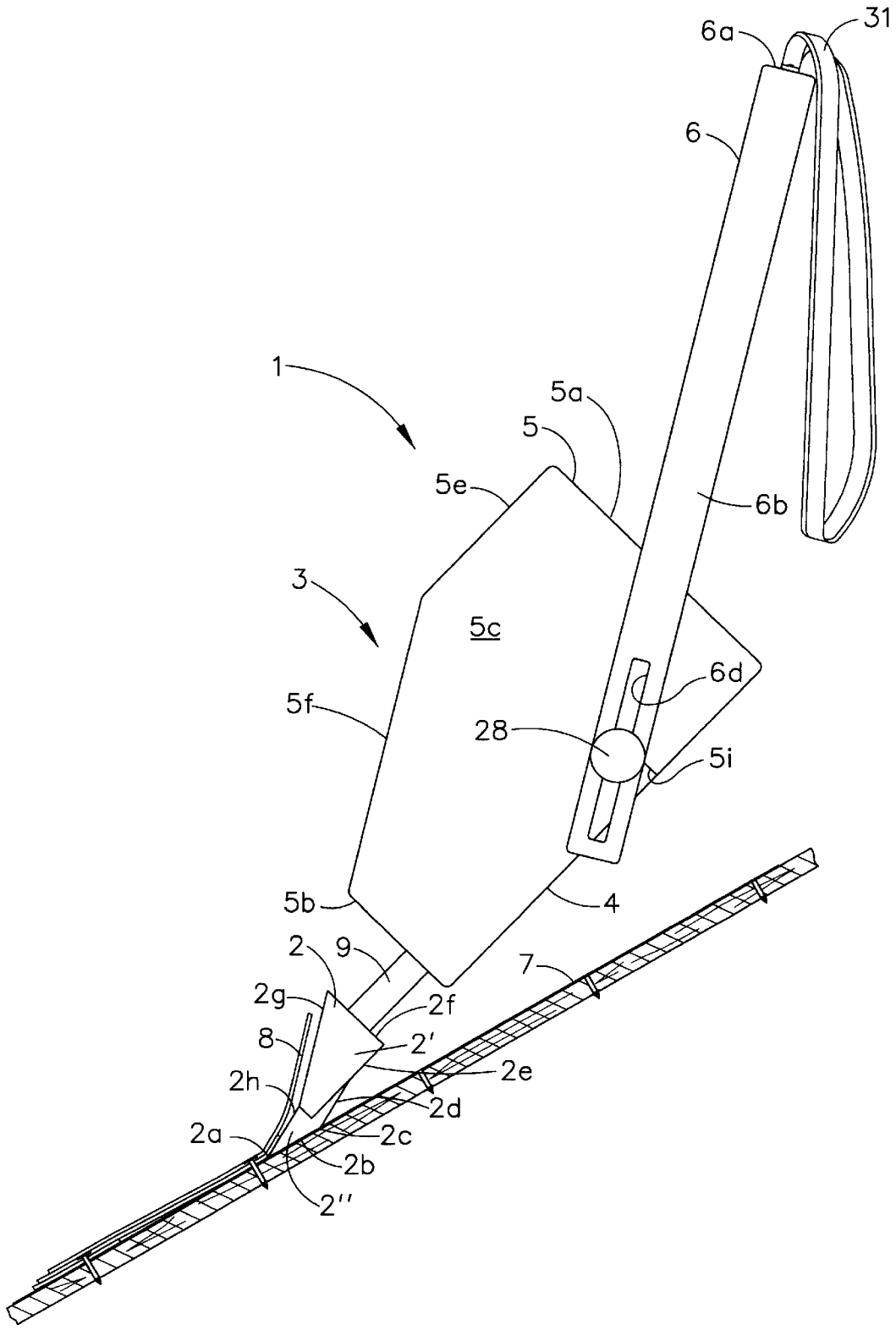
FIG. 1 is a fragmentary side elevational view, illustrating the tool of the present invention removing shingles from the sheathing of a roof.

Reference is first made to FIG. 1 wherein the tool is shown in position to remove shingles and nail heads from the roof sheathing. The tool is generally indicated at 1 and comprises a shingle removing blade 2. The main body of the tool is indicated at 3 and comprises a base 4 and a cover 5. As will be apparent hereinafter, the blade is actuated by mechanism mounted on base 4. Finally, the tool is provided with an adjustable handle 6.

Figure 2:
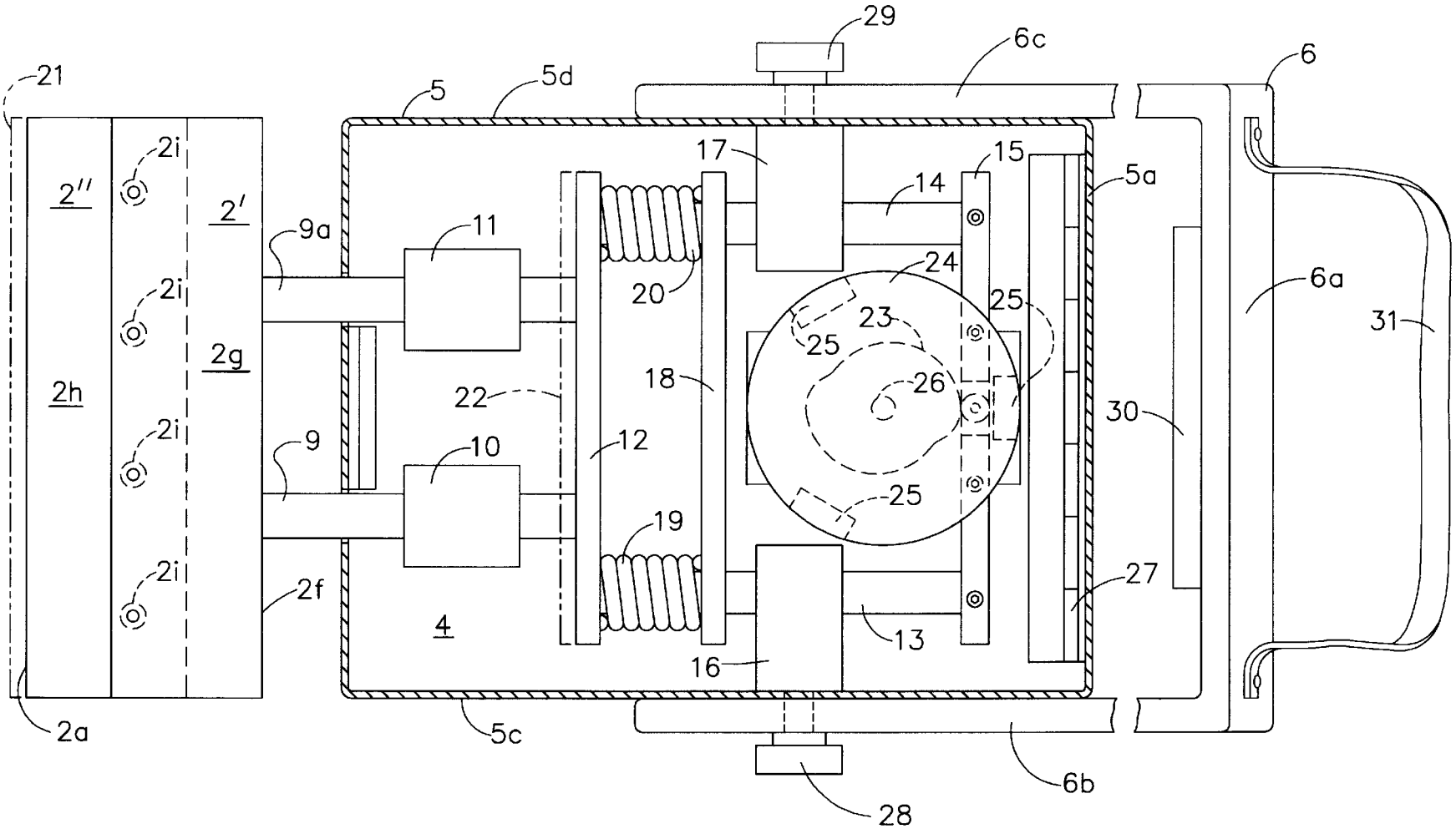
FIG. 2 is a top plan schematic view of the tool of the present invention with its cover removed.
Figure 3:
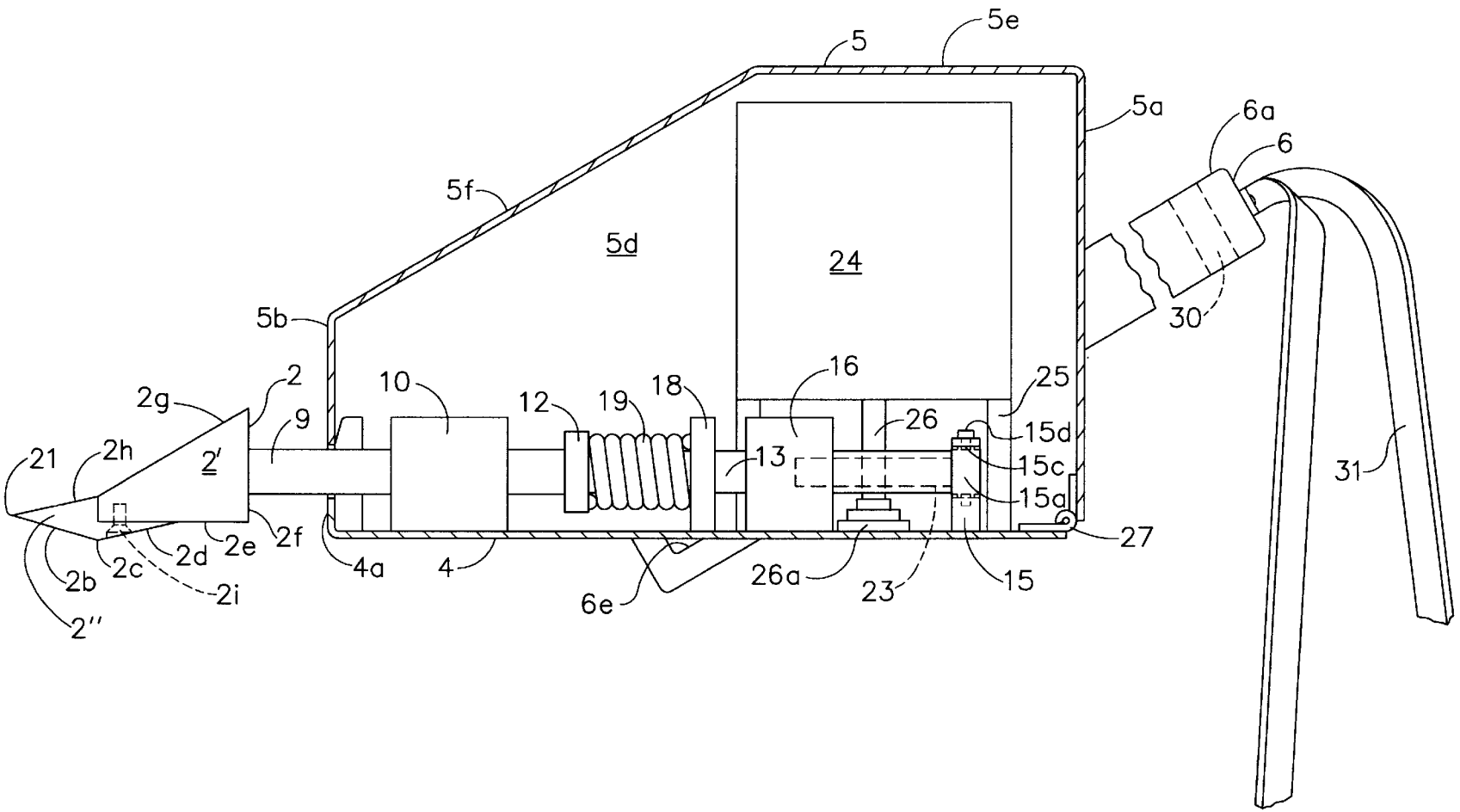
FIG. 3 is a schematic side elevational view of the tool of the present invention with the side of the cover removed.

Reference is now made to FIGS. 2 and 3. The blade 2 is preferably made of tool steel and is provided at its forward end with a sharp forward edge 2*a*. Just behind edge 2*a* there is a planar surface 2*b* which is the primary tool support surface abutting and sliding along the upper surface of the roof sheathing 7, from which the shingles 8 are being removed (see FIG. 1).

The surface 2*b* terminates in an edge 2*c*. The blade edge 2*c* is followed by a pair of planar surfaces 2*d* and 2*e* which serve as clearance surfaces. Surface 2*e* terminates in a planar rearward surface 2*f* of blade 2. Finally, the planar blade surfaces 2*g* and 2*h* are guide surfaces which cause the lifted shingle material to be curled out of the way (again see FIG. 1).

The blade 2 may be a one-piece structure. Preferably, however, it is made up of two pieces 2' and 2". The piece 2" has the sharp edge 2*a*. The piece 2" is removably affixed to piece 2' by machine screws 2I enabling the piece 2" to be sharpened or replaced.

The rearward surface 2*f* of blade 2 supports a pair of blade driving bars 9 and 9*a* extending rearwardly (as viewed in FIGS. 2 and 3) in parallel spaced relationship. Blade driving bars 9 and 9*a* pass, respectively, through front bushing blocks 10 and 11 with a sliding fit. The rearward ends of blade driving bars 9 and 9*a* are affixed to a transverse compression plate 12. Compression plate 12, in turn, supports a pair of rearwardly extending driven bars 13 and 14. The rearward end of driven bars 13 and 14 are affixed to a transversely extending cam follower plate 15.

Driven bars 13 and 14 pass with a sliding fit through rear bushing blocks 16 and 17 which are affixed to base 4. Driven bars 13 and 14 also pass through perforations in a fixed plate 18 which is mounted to base 4. Driven bars 13 and 14 carry compression springs 19 and 20, respectively. It will be noted from FIGS. 2 and 3 that transverse compression plate 12 serves as forward seats for compression springs 19 and 20, while fixed plate 18 serves as rear seats for compression springs 19 and 20.

From the above description, it will be apparent that blade driving bars 9 and 9*a*, compression plate 12, driven bars 13 and 14 and cam follower plate 15 form a shiftable support frame for blade 2. The entire frame is slidably mounted in forward bushing blocks 10 and 11 and rearward bushing blocks 16 and 17. Compression springs 19 and 20 bias blade 2 and its frame-like support to their normal forward position. The forward position of blade 2 is indicated by broken line 21 and the forward position of compression plate 12 is indicated by broken line 22. It will be understood that cam follower plate 15 will move forwardly by the same amount. Both the normal forward position and the retracted position of blade 2 are determined by cam 23, next to be described. While not necessarily so limited, the distance between the normal extended position 21 of blade 2 and its retracted position as shown in FIGS. 2 and 3 may be about ¼ inch.

Figure 6:
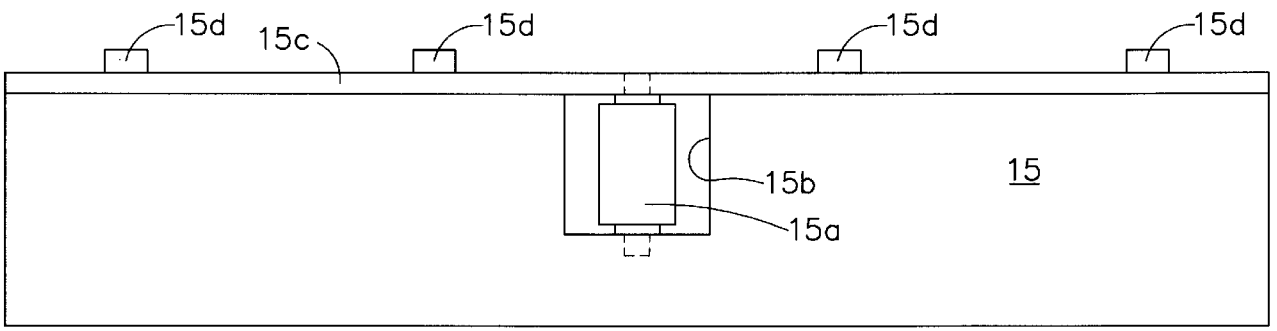
FIG. 6 is an elevational view of the cam follower plate and its cam follower roller.

A prime mover 24 is mounted on base 4 by mounting blocks 25. The mounting blocks are preferably at least three in number. Mounting blocks 25 space prime mover 24 upwardly from base 4, as viewed in FIGS. 2 and 3. The prime mover 24 may be of any appropriate type including an electrical motor, a pneumatic motor, an internal combustion engine, or the like. The tool 1 of the present invention is particularly well adapted for the use of a prime mover in the form of a 110 volt electric motor. It will be noted from FIGS. 2 and 3 that the motor shaft 26 is perpendicular to base 4 and drives the cam 23 which acts upon cam follower plate 15. The free end of motor shaft 26 is provided with a support bearing 26*a* affixed to base 4. The cam preferably has a ¼" drop and rides against a cam follower roller 15*a* mounted in a notch 15*b* in cam follower plate 15 (see FIG. 6). The cam follower roller 15*a* is maintained in contact with cam 23 by compression springs 19 and 20. The cam follower roller 15*a* is provided with appropriate bearings, one mounted in notch 15*b* and one mounted in a strip 15*c* mounted to the upper edge of cam follower plate 15 by a series of machine screws. The motor mounting blocks 25, the front support bushing blocks 10 and 11, the rear bushing blocks 16 and 17, and the fixed plate 18 may all be rigidly attached by appropriate fastening means through the bottom of base plate 4.

The tool 1 is provided with a cover 5. The cover is preferably made of metal, but it may also be made of heavy duty plastic or other appropriate material. The cover may be removably affixed to the base in any appropriate manner. For example, it may attach to the base with a snap fit, or the rear bottom edge of the cover may be hingedly affixed to base 4. Such a hinge is shown a 27 in FIGS. 2 and 3.

Cover 5 may have any appropriate shape. A simple example is shown in FIGS. 3 and 4, having a rear wall 5*a*, a front wall 5*b*, a pair of side walls 5*c* and 5*d*, and top wall portions 5*e* and 5*f*.

Figure 4:
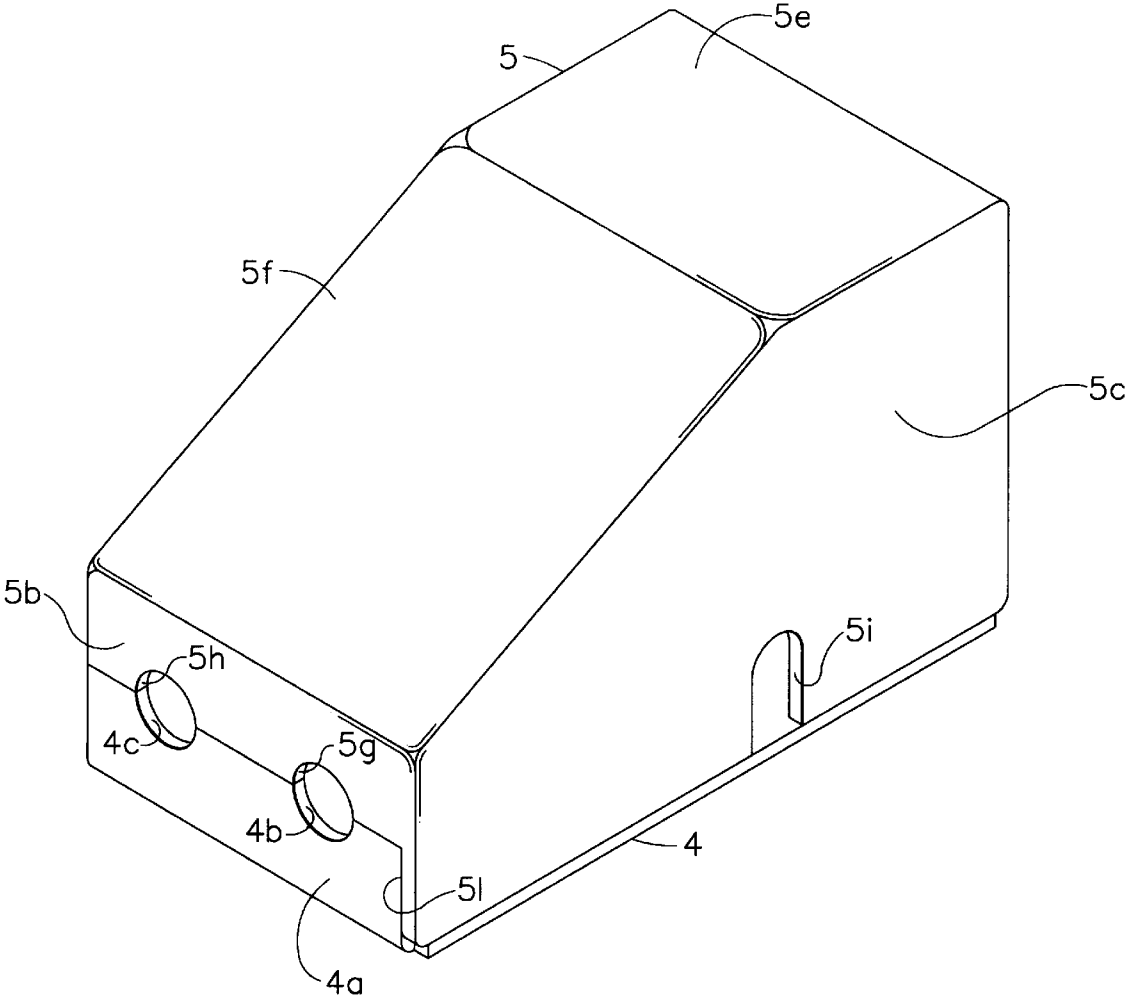
FIG. 4 is a top, front and left side perspective view of the cover and the base.
Figure 5:
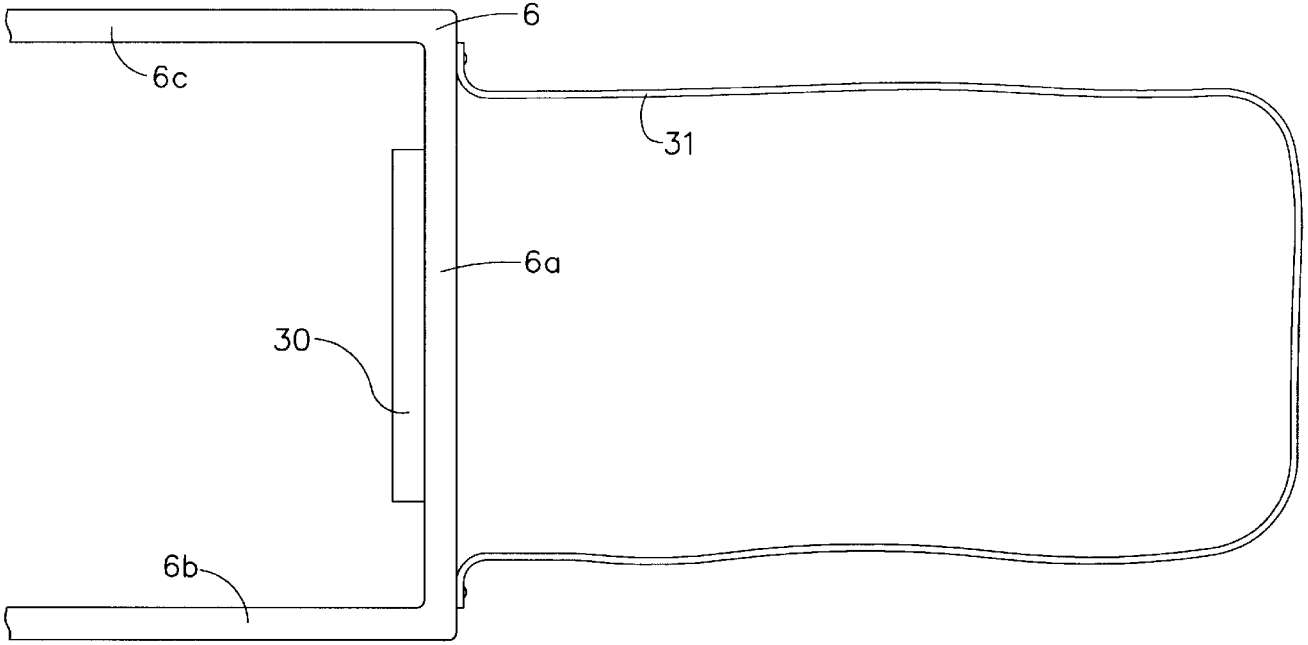
FIG. 5 is a fragmentary plan view of the handle, a trigger, and a carrying strap affixed to the handle.

It would be within the scope of the invention to provide the base with a short, upstanding front wall 4*a* having a pair of semi-circular slots 4*b* and 4*c* extending downwardly from its upper edge and spaced and sized to accommodate the blade driving bars 9 and 9*a* (see FIGS. 2 and 4). The wall 5*b* of cover 5 is provided with a pair of inverted semi-circular slots 5*g* and 5*h* sized and spaced to accommodate blade drive bars 9 and 9*a*. The cover 5 is provided with a cut-out 5I sized to receive base front wall 4*a* as shown in FIG. 4. An alignment member may be affixed to front wall 4*a*. The alignment member has a surface thereon which will assure alignment of cover front wall 5*b* with base front wall 4*a*. The cover 5 may be maintained in its closed position by any appropriate means (not shown) such as a snap fit, a latch, machine screws or the like. The purpose of the cover is not only to protect the operator from the mechanism, but also to maintain the mechanism relatively free of dirt and foreign material generated by the roof removal operation.

The tool 1 is provided with a handle 6 which is preferably adjustable both as to its length and pitch. The handle may be attached to the base 4 or the cover 5.

A bale-type U-shaped exemplary handle is illustrated in FIGS. 1, 2 and 3. The handle 6 has a base portion 6*a* and leg portions 6*b* and 6*c*. The legs 6*b* and 6*c* have formed therein elongated slots 6*d* and 6*e*, respectively. The slots 6*d* and 6*e* are adapted to receive threaded knobs 28 and 29, respectively. Knob 28 passes through slot 6*d* and a slot 5*i* in the side 5*c* of cover 5 (see FIG. 4), and threadedly engages a threaded hole in rear bushing block 16 (see FIG. 2). In a similar fashion, the knob 29 goes through handle slot 6*e*, a slot (not shown) in cover side 5*d* (similar to slot 5*i* in cover side 5*c*) and is threadedly engaged in a threaded bore in rear bushing block 17. Knobs 28 and 29 enable the handle 6 to be adjusted as to length and pitch to suit the tool operator. It will also be understood that knobs 28 and 29 would have to be loosened to enable cover 5 to be opened.

The tool 1 is completed by the provision of a trigger 30. When the trigger 30 is a simple on/off trigger, it may be located at any appropriate place on the tool, including cover 5. It is preferred however that the trigger 30 be of the type which not only turns the motor on and off, but also varies the motor speed (for example from 20% to 100% of the motor rating). Under these circumstances, it is preferred to locate trigger 30 on the base portion 6*a* of handle 6, as shown. The handle 6 may also support a carrying strap 31 for the convenience of the user.

The operator of the tool will use the sharpened edge of the blade to cut under or through the roofing materials to the roof sheathing. Thereafter, the operator will allow the blade to move down the sheathing on blade surface 2*b*. A prying force may be applied to the shingles by rocking the blade on its edge 2*c*. As the tool moves along the roof, the shingles pried up thereby will tend to curl above the tool by virtue of blade surfaces 2*g* and 2*h*, as is indicated in FIG. 1. The tool may be shifted down the roof in the manner shown in FIG. 1. It can be used, however, to attack the shingles from any direction. As is shown in FIG. 1, the blade 2 will also remove the heads of the roofing nails by which the shingles were attached to the sheathing.

In FIG. 2, the blade is shown as having a width approximately the same as the width of tool 1. It would be within the scope of the invention to make blade 2 wider and to change its shape.

Modifications may be made in the invention without departing from the spirit of it.

What is claimed:

1. A powered roof shingle-removing hand tool comprising a blade assembly and a base assembly, said blade assembly comprising a shingle-removing blade and a support mechanism therefor, said base assembly comprising a base member and a prime mover mounted thereon, said blade support mechanism being slidably mounted on said base assembly enabling said support mechanism and said blade to be shifted between a forward position and a retracted position, a biasing mechanism biasing said blade and support mechanism therefor to said forward position, a prime mover drive mechanism for repeatedly shifting said blade and blade support mechanism to said retracted position and releasing said blade and blade support mechanism for shifting to said forward position by said biasing mechanism, whereby said repeated forward movement of said blade cuts through roofing nails and lifts said shingles, upwardly and away from said blade, removing them from said roof.

2. The shingle-removing tool claimed in claim 1 wherein said blade has a forward end comprising a transverse sharp cutting edge, said blade having a bottom comprising a second edge and a planar support surface between said edges, said blade having a rearward surface and at least one clearance surface between said rocking edge and said rearward surface, said blade having at least one top surface configured to curl said shingles being removed upwardly and away from said blade.

3. The shingle-removing tool claimed in claim 1 wherein said blade comprises a rearward body portion attached to said blade support mechanism and a separate forward body portion terminating in a transverse forwardly directed sharp cutting edge followed by a support surface for said blade during operation thereof, said forward and rearward body portions being removably joined together by appropriate fastening means whereby said forward body portion can be removed from said tool for sharpening and replacement.

4. The shingle-removing tool claimed in claim 1 wherein said prime mover is chosen from the class consisting of an electric motor, a hydraulic motor, and an internal combustion engine.

5. The shingle-removing tool claimed in claim 1 including an openable cover mounted on said base, said cover enclosing said blade support mechanism, said biasing mechanism, a motor and said prime mover driven mechanism for said blade assembly.

6. The shingle-removing tool claimed in claim 1 including a handle associated with said tool by which the tool operator can guide said blade and said tool during a shingle removing operation.

7. The single-removing tool claimed in claim 1 wherein said blade support mechanism comprises a pair of blade driving bars affixed to said blade and extending rearwardly therefrom in parallel spaced relationship, a pair of front bushing blocks mounted on said base member, said pair of blade driving bars each being slidably mounted in one of said front bushing blocks, a compression plate extending transversely with respect to said base member, said pair of blade driving bars terminating in rearward ends affixed to said compression plate, a pair of rearwardly directed driven bars in parallel spaced relationship extending from said compression plate, a pair of rear bushing blocks mounted on said base member, said pair of driven bars each being slidably mounted in one of said rear bushing blocks, a transverse cam follower plate being parallel to said compression plate and having a cam follower mounted thereon, said driven bars terminating in rearward ends affixed to said cam follower plate, said assembly of said blade, said drive bars, said compression plate, said driven bars and said cam follower plate comprising said blade assembly shiftable between said forward and retracted positions, said prime mover driven mechanism for repeatedly shifting said blade assembly to said retracted position and releasing said blade assembly for shifting to said forward position by said biasing mechanism comprising a cam driven by said prime mover and contacting said cam follower of said cam follower plate.

8. The shingle-removing tool claimed in claim 1 including a carrying strap affixed to said tool.

9. The shingle-removing tool claimed in claim 7 wherein said biasing mechanism comprises a pair of compression springs each mounted on one of said driven bars between said compression plate and its respective one of said rear bushing blocks.

10. The shingle-removing tool claimed in claim 7 including a transverse plate parallel to said compression plate and affixed to said base member between said compression plate and said rear bushing blocks, said biasing mechanism comprising a pair of compression springs each mounted on one of said driven bars between said compression plate and its respective one of said rear bushing blocks.

11. The shingle-removing tool claimed in claim 7 wherein said blade comprises a rearward body portion attached to said blade support mechanism and a separate forward body portion terminating in a transverse forwardly directed sharp cutting edge followed by a support surface for said blade during operation thereof, said forward and rearward body portions being removably joined together by appropriate fastening means whereby said forward body portion can be removed from said tool for sharpening and replacement.

12. The shingle-removing tool claimed in claim 11 wherein said prime mover is chosen from the class consisting of an electric motor, a hydraulic motor, and an internal combustion engine.

13. The shingle-removing tool claimed in claim 12 including a handle associated with said tool by which the tool operator can guide said blade and said tool during a shingle removing operation.

14. The shingle-receiving tool claimed in claim 13 wherein said handle is adjustable with respect to both length and pitch.

15. The shingle-removing tool claimed in claim 13 wherein said prime mover comprises an electric motor connected to a source of electrical power via an electrical switch.

16. The shingle-removing tool claimed in claim 15 wherein said switch is both an on/off switch and a variable speed switch for said motor.

* * * * *